US012729091B2

(12) United States Patent
Casotti

(10) Patent No.: US 12,729,091 B2
(45) Date of Patent: Sep. 8, 2026

(54) SYSTEM FOR SUPPORT AND MOVEMENT OF A STACK OF INTERFOLDED SHEETS DURING PRODUCTION OF PAPER PRODUCTS IN STACKS OF INTERFOLDED SHEETS IN AN INTERFOLDING MACHINE

(71) Applicant: OT LUCCA S.R.L., Montecarlo (IT)

(72) Inventor: Paolo Casotti, Lucca- Frazione di Antraccoli (IT)

(73) Assignee: OT LUCCA S.R.L., Montecarlo (IT)

( * ) Notice: Subject to any disclaimer, the term of this patent is extended or adjusted under 35 U.S.C. 154(b) by 249 days.

(21) Appl. No.: 18/695,473

(22) PCT Filed: Oct. 18, 2022

(86) PCT No.: PCT/IB2022/059977
§ 371 (c)(1),
(2) Date: Mar. 26, 2024

(87) PCT Pub. No.: WO2023/067486
PCT Pub. Date: Apr. 27, 2023

(65) Prior Publication Data

US 2025/0115453 A1 Apr. 10, 2025

(30) Foreign Application Priority Data

Oct. 20, 2021 (IT) ..... 102021000026912

(51) Int. Cl.
*B65H 31/30* (2006.01)
*B65H 45/24* (2006.01)

(52) U.S. Cl.
CPC ..... *B65H 45/24* (2013.01); *B65H 31/3054* (2013.01); *B65H 2404/2693* (2013.01)

(58) Field of Classification Search
CPC ..... B65H 31/30; B65H 31/3009; B65H 31/3054; B65H 45/24; B65H 45/101; B65H 2404/2693; B65H 2701/1924
(Continued)

(56) References Cited

U.S. PATENT DOCUMENTS 4,494,741 A 1/1985 Fischer et al.
5,088,707 A * 2/1992 Stemmler ..... B65H 45/28 270/32
(Continued)

OTHER PUBLICATIONS

International Search Report and Written Opinion mailed Feb. 2, 2023 for PCT/IB2022/059977, 9 pages.

*Primary Examiner* — Leslie A Nicholson, III
(74) *Attorney, Agent, or Firm* — Jacob M. Ward; Ward Law Office LLC

(57) ABSTRACT

The system for support and movement of a stack of interfolded sheets during production of stacks of interfolded sheets in an interfolding machine comprises: at least a support table supporting a stack of interfolded sheets under formation; a conveyor belt transporting the formed stack towards a work station. The support table is movable from a first raised position to a second raised position to allow formation of a complete stack of interfolded sheets and, after the stack of interfolded sheets has been completed at the desired height, is movable towards the conveyor belt to deposit the stack thereon. Translating means for vertically translating the conveyor belt and adjusting the position of the conveyor belt, and therefore the distance of the conveyor belt, with respect to the second raised position into which the support table is brought for the completion of the formation of the stack of interfolded sheets.

11 Claims, 4 Drawing Sheets

(58) Field of Classification Search
USPC ..... 270/32, 39.01
See application file for complete search history.

(56) References Cited

U.S. PATENT DOCUMENTS

| | | | | |
|---|---|---|---|---|
| 5,730,695 | A * | 3/1998 | Hauschild | B65H 31/32 270/39.02 |
| 8,240,653 | B2 * | 8/2012 | Walsh | B65H 45/24 270/39.02 |
| 8,419,002 | B2 * | 4/2013 | Walsh | B65H 31/3045 270/39.02 |
| 8,882,098 | B2 * | 11/2014 | Walsh | B65H 41/00 270/39.02 |
| 2011/0158782 | A1 | 6/2011 | Walsh et al. | |
| 2024/0199363 | A1 * | 6/2024 | Damiani | B65H 45/24 |

* cited by examiner

SYSTEM FOR SUPPORT AND MOVEMENT OF A STACK OF INTERFOLDED SHEETS DURING PRODUCTION OF PAPER PRODUCTS IN STACKS OF INTERFOLDED SHEETS IN AN INTERFOLDING MACHINE

FIELD OF THE INVENTION

The present invention relates to the technical sector concerning production of paper material in packs of interfolded sheets, i.e. with the sheets folded in a zig-zag with respect to one another, such as for example packs of paper handkerchieves, napkins, towels, and the like.

In this technical sector, the sheets that are to be folded in an interfolded way for the formation of a stack (pack) of sheets can be fed in the form of continuous strips or already-cut single sheets to folding means which are configured and predisposed to fold the strips or single sheets in an interfolded way by carrying out one or more folds, in order to obtain packs of interfolded sheets, for example shaped in an L shape (2 folds), or a Z shape (3 folds), or a W shape (4 folds), and so on.

By folding the continuous strips or the already-cut single sheets in this way, a stack of interfolded sheets is formed, which, once the predetermined height has been reached for the type of products (complete pack), the stack is separated using special separation means from the successive stack of interfolded sheets under formation.

DESCRIPTION OF THE PRIOR ART

The apparatus set up to carry out the above-described operations are known in the sector as interfolding machines.

The interfolding machines usually comprise folding means which are constituted by a first series of intercalated rollers, for unwinding a first strip or a first series of already-cut sheets in succession to one another, and by a second series of intercalated rollers, for unwinding a second strip or a second series of already-cut sheets in succession to one another, and by a plurality of folding elements (known in the sector jargon as "hands") which insert between the various rollers to abut the strips or sheets and carry out the zig-zag folding thereof, as well as interfolding the strips or sheets with one another and thus forming a stack of interfolded sheets.

For the separation of the formed stack (i.e. which has reached the predetermined height for the pack of interfolded sheets which is to be produced) from the successive stack under formation, the interfolding machines comprise separation means (in the case of sheets that have already been cut) or tearing means (in the case of continuous strips having pre-weakened lines or tab-bonds) which are constituted by elements having a plate or table shape which insert laterally and transversally to the strips or sheets being folded to carry out the separation of the already-formed stack of interfolded sheets from the successive stack under formation.

In the interfolding machines like the ones described in the foregoing, a system is present for supporting the stacks of interfolded sheets under formation and for the movement of the stack of interfolded sheets already-formed, once separated from the successive one under formation, which is to be moved and transported out of the machine for successive operations (for example packing).

The present invention concerns a system for support and movement of a stack of interfolded sheets during production of stacks of interfolded sheets in interfolding machines.

A system at present used in interfolding machines for support and movement of a stack of interfolded sheets during production of stacks of interfolded sheets comprises at least a support table or element, known in the sector as a formation table, which can for example be constituted by a single fork of a facing pair of forks, and by a conveyor belt, which is arranged at a fixed height inferiorly of the support table.

The support table is configured and predisposed to restingly receive the interfolded sheets folded by the folding means of the interfolding machine for the formation of the stack of interfolded sheets, while the conveyor belt is destined to restingly receive the stack of interfolded sheets from the support table, when the support table is lowered once the stack of interfolded sheets has been formed at the desired height.

In this regard, the support table is movable by respective movement means which are configured in such a way as to be able to position the support table in a first raised position, for example having a maximum height with respect to the conveyor belt, in proximity of the folding means, so that the first interfolded sheets of a stack of interfolded sheets which is to be formed can be arranged thereon, and then slowly moving the support table downwards to a second raised position, for example having a minimum height with respect to the conveyor belt, to allow the folding of the sheets thereof to form the stack of interfolded sheets of the desired height.

Once the stack of interfolded sheets has been formed at the desired height, the separation means present in the interfolding machine separate the formed stack from the successive stack under formation, and the support table is lowered vertically from the second raised position to the conveyor belt in order to deposit the formed stack thereon.

The conveyor belt is then activatable to move and transport the formed stack of interfolded sheets deposited thereon externally of the interfolding machine, for successive operations, for example packing.

According to the type of end products to be produced, the stack of interfolded sheets can have different heights and therefore, when there is a size change, the movement means must move, time by time, the support table, by lowering it from the first raised position to a second raised position which is located at a second minimum height that is different to the height of the conveyor belt.

Thus, for example, in the case of a size change which requires the formation of a stack with a lower height with respect to the preceding functioning, the movement means, during the formation of the stack of interfolded sheets, will have to lower the support table from the first raised position, at the maximum height, to a second raised position which is located at a minimum height with respect to the conveyor belt with a height (distance) that is greater with respect to the preceding functioning.

Then, once the new stack of interfolded sheets has been formed, the support table will have to perform a longer run in order to lower to the conveyor belt and deposit the formed stack thereon.

In these cases, a longer time will be required to deposit the stacks of interfolded sheets with respect to the preceding functioning, with a consequent drop in the production level.

A possible solution, at present in use, consists in commanding the movement means of the support table so that the support table is lowered towards the conveyor belt with a greater velocity.

This mode, however, is not simple to actuate, as it can be problematic to continuously vary the movement mode of the support table according to the height of the stack of interfolded sheets which time by time, following the size change, it is desired to produce.

SUMMARY OF THE INVENTION

The aim of the present invention is therefore to describe a new system for support and movement of a stack of interfolded sheets during production of stacks of interfolded sheets in an interfolding machine able to obviate the drawbacks mentioned in the foregoing and at the same time to guarantee a constantly high production level.

The cited aim is attained by means of a system for support and movement of a stack of interfolded sheets during production of stacks of interfolded sheets in an interfolding machine according to the contents of the claims.

BRIEF DESCRIPTION OF THE DRAWINGS

The characteristics of a preferred, but not exclusive, embodiment of the system of the present invention will be described in the following description with reference to the appended tables of drawings, in which.

DESCRIPTION OF THE PREFERRED EMBODIMENTS

Figure 1:
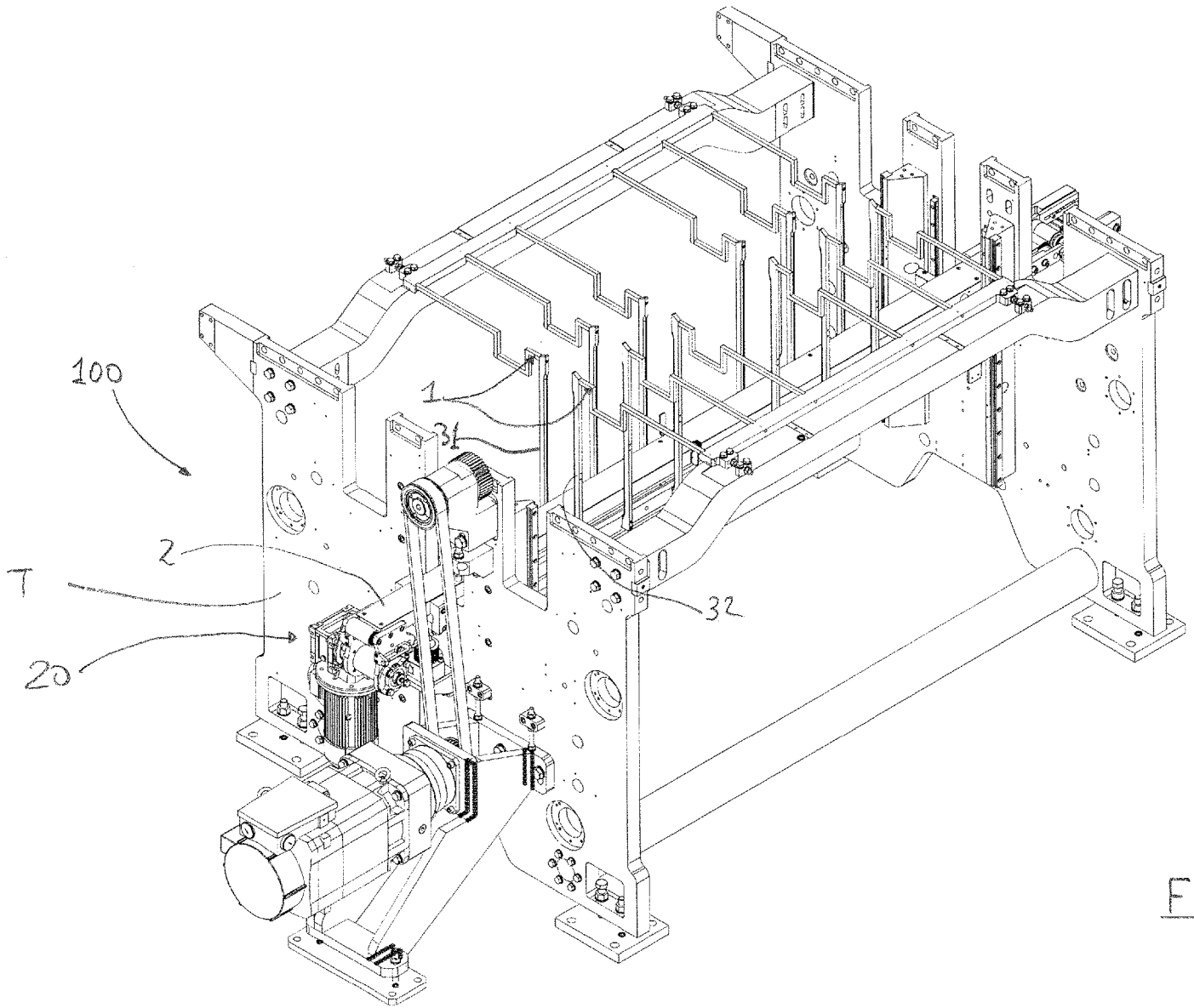
FIG. 1 illustrates, in a schematic and perspective view, the main components of the system of the invention.
Figure 2:
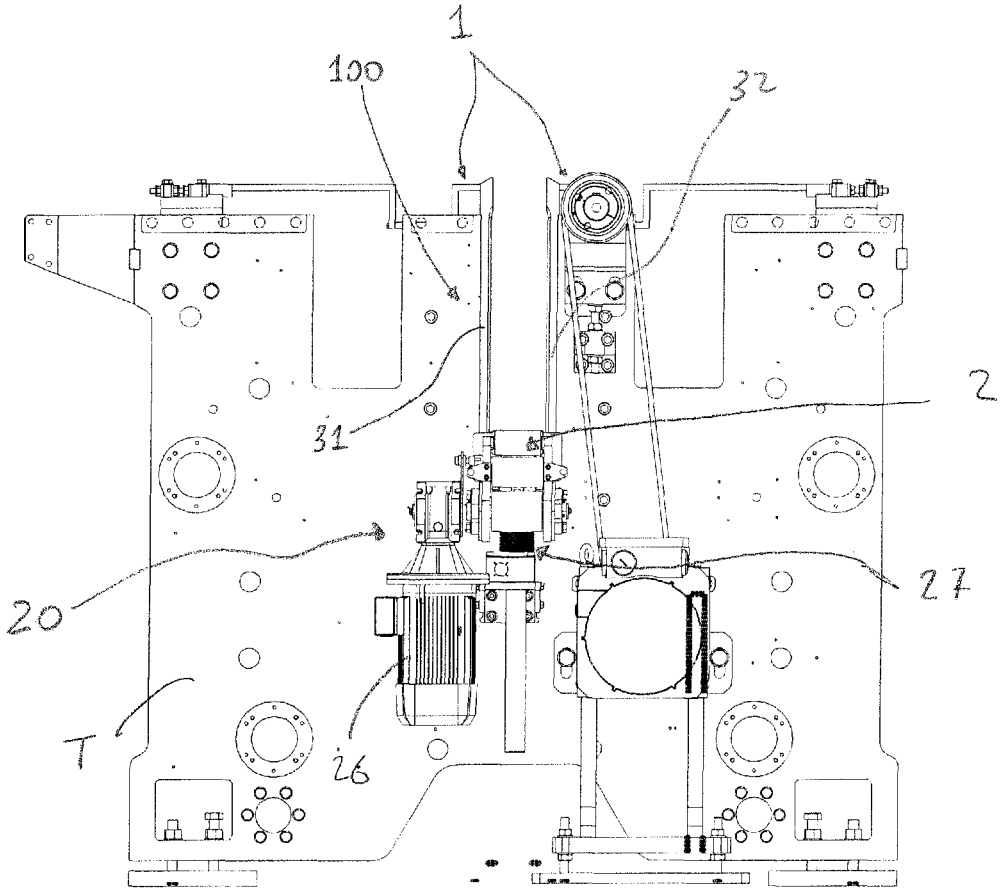
FIG. 2 schematically illustrates, in a frontal view, the system of FIG. 1.
Figure 3:
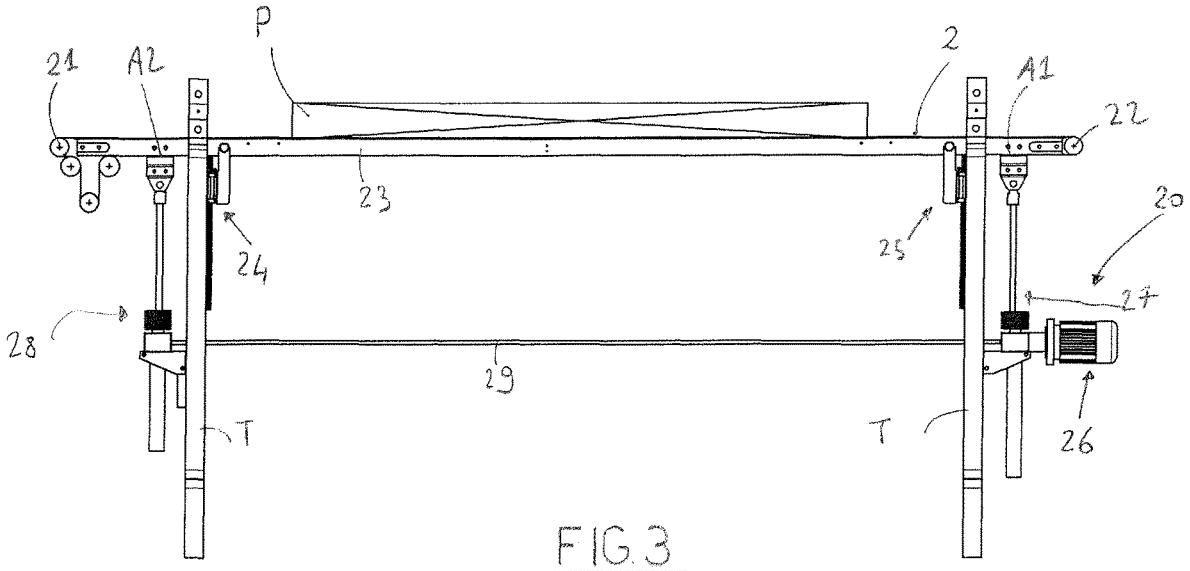
FIG. 3 illustrates, in a schematic lateral view, some particular components of the system of the invention in a first possible operating configuration.
Figure 4:
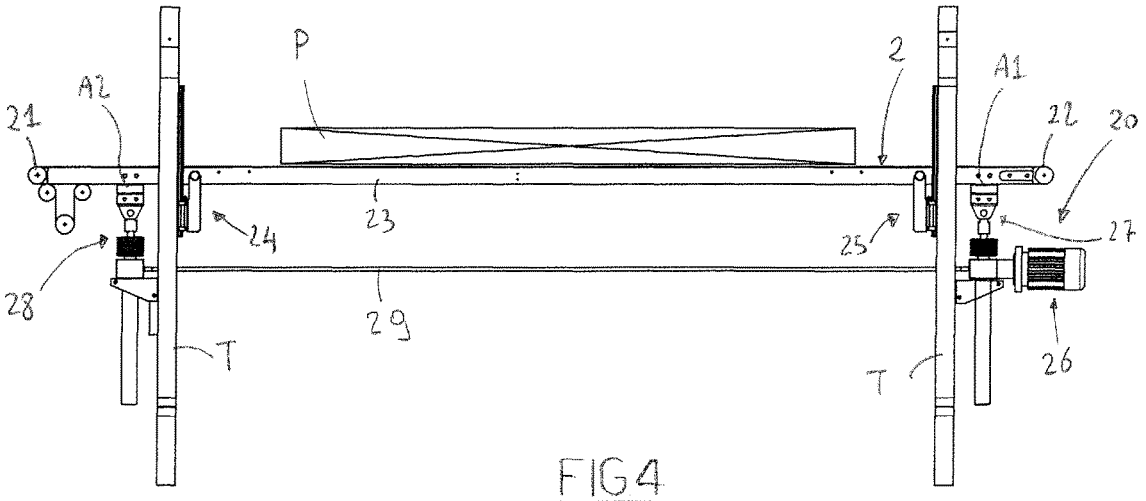
FIG. 4 illustrates, again in a schematic lateral view, the components of the system of FIG. 3, in a second possible operating configuration.

With reference to the accompanying tables of drawings, reference numeral (100) denotes a system for support and movement of a stack of interfolded sheets during production of stacks of interfolded sheets in an interfolding machine.

The drawings provide the interfolding machine has not been illustrated in detail, as it can be of known type or realised in various modes, and the structure or functioning thereof for realising the interfolded folding of sheets to form a stack of interfolded sheets is not relevant to the present invention.

Only in figures from 6A to 8B, reference (V) schematically denotes unwinding and folding means (V) of sheets usually present in an interfolding machine for folding the sheets in an interfolded way and for forming a stack (P) of interfolded sheets of a desired height; the formed stack (P) of interfolded sheets to be supported and moved by means of the system (100) of the invention.

The system (100) of the invention comprises:

support and movement means (1) of a stack (P) of interfolded sheets, which are made in such a way as to comprise at least a support table (10) which support table (10) is predisposed and configured to support a stack (P) of interfolded sheets under formation up to complete formation of a stack (P) of interfolded sheets of a desired height;

a conveyor belt (2), which is configured to be able to restingly receive a formed stack (P) of interfolded sheets and transport the formed stack (P) of interfolded sheets towards a work station (for example a packaging station, not illustrated in the tables of drawings as not concerning the invention).

The at least a support table (10), for the formation of a stack (P) of interfolded sheets of a desired height, is vertically movable superiorly of the conveyor belt (2) in order to be positionable in a first raised position (S1), in order to start to restingly receive the folded sheets folded in an interfolded way from the unwinding and folding means (V) of the interfolding machine, and then, during the interfolded folding of the sheets, is movable vertically downwards in order to enable the formation of a stack (P) of interfolded sheets until it is positioned in a second raised position (S2) at which the formation of the stack (P) of interfolded sheets is completed, at the desired height.

The at least a support table (10), after the stack (P) of interfolded sheets has been formed at the desired height, is movable from the second raised position (S2) towards the conveyor belt (2) in such a way as to be able to deposit the formed stack (P) of interfolded sheets on the conveyor belt (2) and thus to be returned into the first raised position (S1) so as to restingly receive a next stack of interfolded sheets under formation.

In the appended figures detailed illustration of the means for the movement of the support table (10) is not given in detail as these can be make according to the various modes known to the technical expert in the sector.

Figure 6A:
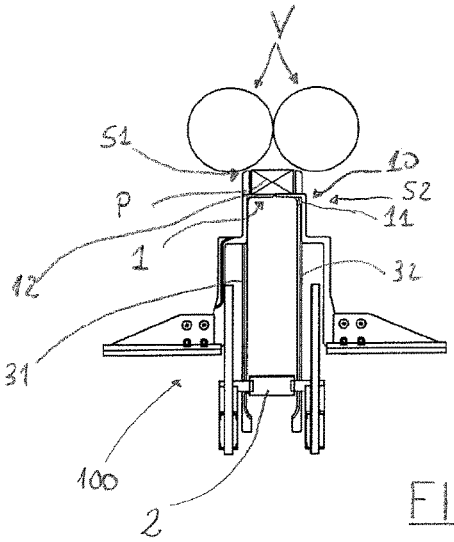
FIGS. 6A, and 6B illustrate, in respective frontal schematic views, the functioning of some components of the system in a first possible operating configuration.
Figure 7A:
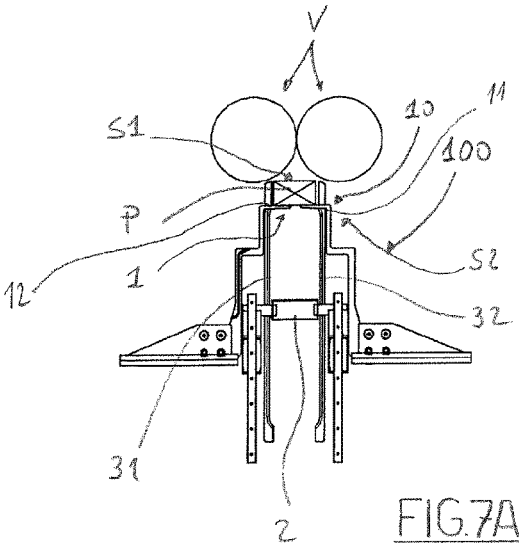
FIGS. 7A and 7B illustrate, in respective frontal schematic views, the functioning of some components of the system in a second possible operating configuration.
Figure 8A:
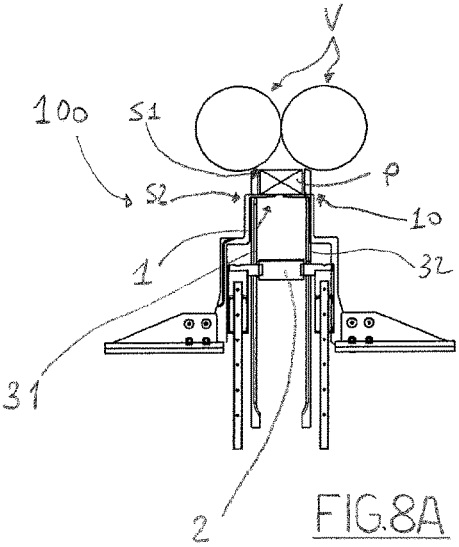
FIGS. 8A and 8B illustrate, in respective frontal schematic views, the functioning of some components of the system in a third possible operating configuration.

Further, in FIGS. 6A, 7A and 8A, the first raised position (S1) in which the support table (10) can be positioned in order to start to restingly receive the sheets folded in an interfolded way from the unwinding and folding means (V) of the interfolding machine is schematically denoted only with relative arrows.

In this first raised position (S1), the support table is positioned in proximity of the unwinding and folding means (V) of the interfolding machine; in this first raised position (S1) it can be said that the support table (10) is at a maximum height from the ground, or from the support surface of the interfolding machine.

According to the type of products that are to be made in the interfolding machine, the formed stack (P) of interfolded sheets may time-by-time be at a different height, and therefore the second raised position (S2) in which the support table (10) is borne during the vertical movement downwards thereof from the first raised position (S1), for the completion of the formation of the stack (P), can be positioned, time by time, at a minimum height that is different to the ground, or with respect to a rest surface of the interfolding machine.

The special characteristics of the system (100) of the present invention consist in the fact that it is made in such a way as to comprise translating means (20) of the conveyor belt (2) which are predisposed and configured, according to the height of the stack (P) of interfolded sheets which is to be formed, so as to vertically translate the conveyor belt (2) and adjust the position of the conveyor belt (2), and therefore the distance of the conveyor belt (2), with respect to the second raised position (S2) into which the support table (10) is brought for the completion of the formation of the stack (P) of interfolded sheets.

In this way, it is possible to vary and adjust the height position of the conveyor belt (2) and reduce the entity of the vertical run that the support table (10) must perform, once having reached the second raised position (S2) of completion of the formation of a stack of interfolded sheets, to bring the formed stack (P) of interfolded sheets above the conveyor belt (2), in a case in which the stack to be formed has a predetermined height that is lower than a preset maximum height for which reason the positioning of the conveyor belt is set at a minimum height from the ground or from the support surface of the interfolding machine.

Thus, the height position of the conveyor belt (2), i.e. the position and distance thereof from the second raised position (S2) reached by the support table (10) for the completion of the formation of the stack (P) of interfolded sheets, can be varied and adjusted time by time according to the effective height of the stack which is formed, or according to the specific production requirements as a function of the number of stacks to be completed in a unit of time.

In fact, in a case of reduction of the height of the stacks of interfolded sheets which are to be formed, and therefore on the positioning of the support table (10) in a second raised position which is located at a height (distance) that is superior to the ground, or than the support surface of the interfolding machine, or than a position of the conveyor belt used for a preceding production cycle, it is possible, by translating the conveyor belt (2) upwards and positioning it in a higher position, to reduce the entity of the run that the support table must perform in order to bring the formed stack of interfolded sheets onto the conveyor belt.

The regulation and variation of the height of the position of the conveyor belt can also be carried out with a constant height of the stacks of interfolded sheets which are formed, with the aim of reducing the entity of the run that the support table has to perform in order to transfer the formed stacks above the conveyor belt, and therefore, given a same velocity of movement of the support table, to increase the number of formed stacks in the unit of time that the conveyor belt has to transport towards a successive work station, and thus increase productivity.

Figure 6B:
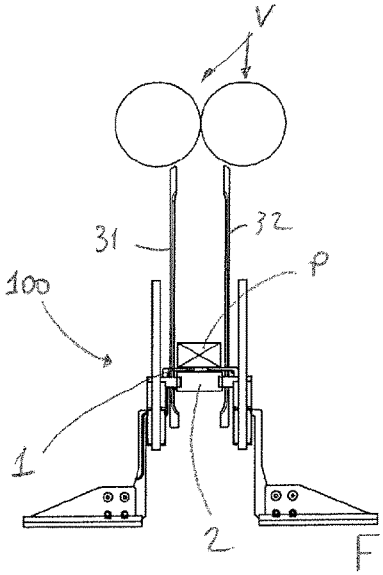
Figure 7B:
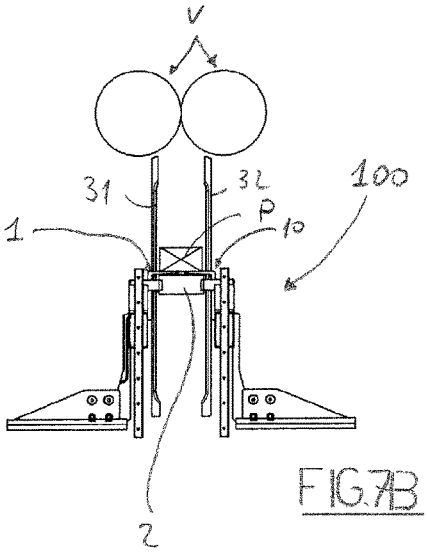
Figure 8B:
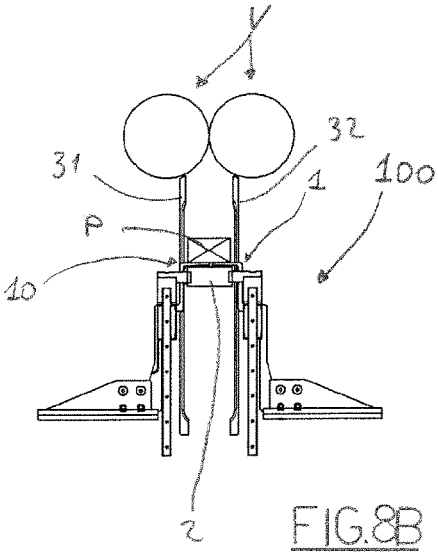

For example, in FIGS. 6B, 7B, and 8B, three distinct positions are illustrated in which the conveyor belt (2) can be translated and positioned by the translating means (20) with respect to the second raised position (S2) into which the support table (10) is lowered and brought for the formation of a completed stack of interfolded sheets.

Further aspects of the system of the present invention are described in the following.

In a first aspect, the conveyor belt (2) is preferably closed loop-wound on relative activation pulleys (21, 22) which are mounted on a support member (23 interposed between the activation pulleys (21, 22) and arranged internally of the loop-wound conveyor belt.

The support member (23) is mounted slidably vertically by means of respective straight sliding guides (24, 25) borne by a frame (T), while the translating means (20) are configured and predisposed to be connected to the support member (23) in order to translate the support member (23) vertically with respect to the respective straight sliding guides (24, 25) and thus vary a distance of the conveyor belt (2) from the position of the support table (10) when the support table (10) is in the second raised position (S2) for the completion of the formation of the stack (P) of interfolded sheets at the desired height.

According to the preferred, though not exclusive, embodiment illustrated in the accompanying figures of the drawings, the translating means (20) can be made in such in such a way as to comprise at least a motor (26), mounted on the frame (T), at least a first jack (27), activatable by the motor (26) and connected at a first point (A1) to the support member (23) of the conveyor belt (2).

Figure 5:
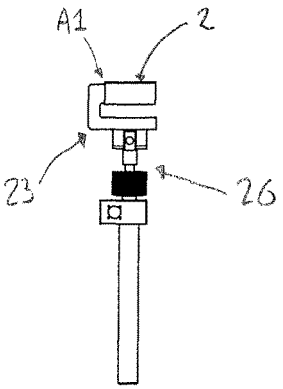
FIG. 5 shows, in a schematic front view, some significant details of the system of the invention.

For example, as illustrated for example in FIG. 5, a U-shaped connecting element can be associated to the jack (26) to connect the end of the jack laterally to the support member (23), without interfering with the conveyor belt that is closed loop-wound on the activation pulleys (21, 22).

Further, the translating means (20) can be made in such a way as to comprise at least a second jack (28), mounted on the frame (T) and connected at a second point (A2) to the support member (23) of the conveyor belt (2), and a connecting bar (29) for connecting the first jack (27) to the second jack (28).

In this case too, the connection of the second jack to a second point of the support member can be made as with the first jack, i.e. using a U-shaped connecting element.

The translating means (20), in order to translate the conveyor belt (2) vertically, can also be realised according to other equivalent modes to the ones described, and made according to the knowledge and abilities of the technical expert in the sector in the matter of vertical translations of mechanical components and/or conveyors.

The at least a support table (10) can be made in such a way as to comprise a single fork element or a pair of fork elements (11, 12) facing one another, such as for example in the preferred but not exclusive embodiment, illustrated in the figures.

A further advantageous aspect consists in the fact that the system (100) of the invention can comprise vertical guide bars (31, 32) of the stacks (P) of interfolded sheets, which are arranged vertically, facing one another and parallel in order to laterally guide the stack (P) of interfolded sheets under formation, during the movement of the support table (10), from the first raised position (S1) to the second raised position (S2), as well as to laterally guide the formed stack (P) of interfolded sheets during the movement of the support table (10) from the second raised position (S2) towards the conveyor belt (2).

In particular, the vertical guide bars (31, 32) are distanced from one another in such a way as to enable passage of the conveyor belt (2) between them when the conveyor belt (2) is vertically translated by the translating means (20) in order to vary the distance of the position of the support table (10) therefrom when the support table (10) is in the second raised position (S2) for the completion of the formation of the stack (P) of interfolded sheets at the desired height.

The invention claimed is:

1. A system for support and movement of a stack of interfolded sheets during production of stacks of interfolded sheets in an interfolding machine, wherein the interfolding machine comprises unwinding and folding means of sheets for folding the sheets in an interfolded way to form a stack of interfolded sheets of a desired height, the system comprising:

support and movement means of a stack of interfolded sheets comprising at least a support table predisposed to support a stack of interfolded sheets under formation up to formation of a completed stack of interfolded sheets of a desired height;

a conveyor belt, configured to be able to restingly receive a completed stack of interfolded sheets and transport the completed stack of interfolded sheets towards a work station;

wherein the at least a support table, for the formation of a stack of interfolded sheets of a desired height, is vertically movable superiorly of the conveyor belt in order to be positionable in a first raised position (S1), in order to start to restingly receive the sheets folded in an interfolded manner from the unwinding and folding means of the interfolding machine, and then, during the folding in an interfolded manner of the sheets, is movable vertically downwards in order to enable the formation of a stack of interfolded sheets until it is positioned in a second raised position (S2) at which the formation of the stack (P) of interfolded sheets is completed, at the desired height, wherein the at least a support table, after the stack of interfolded sheets has been formed at the desired height, is movable from the second raised position (S2) towards the conveyor belt in such a way as to deposit the formed stack of interfolded sheets on the conveyor belt and then be returned into the first raised position (S1) in order to restingly receive a next stack of interfolded sheets under formation;

the system being characterised in that it comprises translating means of the conveyor belt which are arranged and configured, according to the height of the stack of interfolded sheets which is to be formed, in order to translate the conveyor belt vertically and adjust the position of the conveyor belt, and therefore the distance of the conveyor belt, with respect to the second raised position (S2) into which the support table is brought for the completion of the formation of the stack of interfolded sheets; and wherein the conveyor belt is closed loop-wound on relative driving pulleys which are mounted on a support member interposed between the driving pulleys and arranged internally of the loop-wound conveyor belt, wherein the support member is mounted slidably vertically by means of respective straight sliding guides on a frame, and wherein the translating means are configured and arranged to be connected to the support member in order to translate the support member vertically with respect to the respective straight sliding guides and thus vary a distance of the conveyor belt from the position of the support table when the support table is in the second raised position (S2) for the completion of the formation of the stack of interfolded sheets at the desired height.

2. The system as claimed in claim 1, wherein the translating means comprise at least a motor, mounted on the frame, at least a first jack, activatable by the motor and connected at a first point (A1) to the support member of the conveyor belt.

3. The system as claimed in claim 2, wherein the translating means comprise at least a second jack, mounted on the frame and connected at a second point (A2) to the support member of the conveyor belt, and a connecting bar to connect the first jack to the second jack.

4. The system as claimed in claim 1, wherein the at least a support table comprises a fork element or a pair of fork elements facing one another.

5. The system as claimed in claim 2, comprising vertical guide bars of the stack of interfolded sheets, arranged vertically facing one another and parallel in order to laterally guide the stack of interfolded sheets under formation, during the movement of the support table from the first raised position (S1) to the second raised position (S2), and in order to laterally guide the formed stack of interfolded sheets during the movement of the support table from the second raised position (S2) towards the conveyor belt, wherein the vertical guide bars are distanced from one another in such a way as to enable passage between them of the conveyor belt when the conveyor belt is translated vertically by the translating means in order to vary the distance of the conveyor belt from the position of the support table when the support table is in the second raised position (S2) for the completion of the formation of the stack of interfolded sheets at the desired height.

6. A system for support and movement of a stack of interfolded sheets during production of stacks of interfolded sheets in an interfolding machine, wherein the interfolding machine comprises an unwinder/folder for folding the sheets in an interfolded way to form a stack of interfolded sheets of a desired height, the system comprising:

at least a support table predisposed to support a stack of interfolded sheets under formation up to formation of a completed stack of interfolded sheets of a desired height;

a conveyor belt, configured to be able to restingly receive a completed stack of interfolded sheets and transport the completed stack of interfolded sheets towards a work station;

wherein the at least a support table, for the formation of a stack of interfolded sheets of a desired height, is vertically movable superiorly of the conveyor belt in order to be positionable in a first raised position (S1), in order to start to restingly receive the sheets folded in an interfolded manner from the unwinder/folder of the interfolding machine, and then, during the folding in an interfolded manner of the sheets, is movable vertically downwards in order to enable the formation of a stack of interfolded sheets until it is positioned in a second raised position (S2) at which the formation of the stack of interfolded sheets is completed, at the desired height, wherein the at least a support table, after the stack of interfolded sheets has been formed at the desired height, is movable from the second raised position (S2) towards the conveyor belt in such a way as to deposit the formed stack of interfolded sheets on the conveyor belt and then be returned into the first raised position (S1) in order to restingly receive a next stack of interfolded sheets under formation;

the conveyor belt including a translator arranged and configured, according to the height of the stack of interfolded sheets which is to be formed, in order to translate the conveyor belt vertically and adjust the position of the conveyor belt, and therefore the distance of the conveyor belt, with respect to the second raised position (S2) into which the support table is brought for the completion of the formation of the stack of interfolded sheets; and comprising vertical guide bars of the stack of interfolded sheets, arranged vertically facing one another and parallel in order to laterally guide the stack of interfolded sheets under formation, during the movement of the support table from the first raised position (S1) to the second raised position (S2), and in order to laterally guide the formed stack of interfolded sheets during the movement of the support table from the second raised position (S2) towards the conveyor belt, wherein the vertical guide bars are distanced from one another in such a way as to enable passage between them of the conveyor belt when the conveyor belt is translated vertically by the translator in order to vary the distance of the conveyor belt from the position of the support table when the support table is in the second raised position (S2) for the completion of the formation of the stack of interfolded sheets at the desired height.

7. The system as claimed in claim 6, wherein the conveyor belt is closed loop-wound on relative driving pulleys which are mounted on a support member interposed between the driving pulleys and arranged internally of the loop-wound conveyor belt, wherein the support member is mounted slidably vertically by respective straight sliding guides on a frame, and wherein the translator is configured and arranged to be connected to the support member in order to translate the support member vertically with respect to the respective straight sliding guides and thus vary a distance of the conveyor belt from the position of the support table when the support table is in the second raised position (S2) for the completion of the formation of the stack of interfolded sheets at the desired height.

8. The system as claimed in claim 7, wherein the translator comprises at least a motor, mounted on the frame, at least a first jack, activatable by the motor and connected at a first point (A1) to the support member of the conveyor belt.

9. The system as claimed in claim 8, wherein the translator comprises at least a second jack, mounted on the frame and connected at a second point (A2) to the support member of the conveyor belt, and a connecting bar to connect the first jack to the second jack.

10. The system (100) as claimed in claim 6, wherein the at least a support table (10) comprises a fork element or a pair of fork elements (11, 12) facing one another.

11. A system for support and movement of a stack of interfolded sheets during production of stacks of interfolded sheets in an interfolding machine, wherein the interfolding machine comprises an unwinder/folder for folding the sheets in an interfolded way to form a stack of interfolded sheets of a desired height, the system comprising:

at least a support table predisposed to support a stack of interfolded sheets under formation up to formation of a completed stack of interfolded sheets of a desired height;

a conveyor belt, configured to be able to restingly receive a completed stack of interfolded sheets and transport the completed stack of interfolded sheets towards a work station;

wherein the at least a support table, for the formation of a stack of interfolded sheets of a desired height, is vertically movable superiorly of the conveyor belt in order to be positionable in a first raised position (S1), in order to start to restingly receive the sheets folded in an interfolded manner from the unwinder/folder of the interfolding machine, and then, during the folding in an interfolded manner of the sheets, is movable vertically downwards in order to enable the formation of a stack of interfolded sheets until it is positioned in a second raised position (S2) at which the formation of the stack of interfolded sheets is completed, at the desired height, wherein the at least a support table, after the stack of interfolded sheets has been formed at the desired height, is movable from the second raised position (S2) towards the conveyor belt in such a way as to deposit the formed stack of interfolded sheets on the conveyor belt and then be returned into the first raised position (S1) in order to restingly receive a next stack of interfolded sheets under formation, the at least a support table (10) comprising a fork element or a pair of fork elements (11, 12) facing one another;

the conveyor belt including a translator arranged and configured, according to the height of the stack of interfolded sheets which is to be formed, in order to translate the conveyor belt vertically and adjust the position of the conveyor belt, and therefore the distance of the conveyor belt, with respect to the second raised position (S2) into which the support table is brought for the completion of the formation of the stack of interfolded sheets, wherein the conveyor belt is closed loop-wound on relative driving pulleys which are mounted on a support member interposed between the driving pulleys and arranged internally of the loop-wound conveyor belt, wherein the support member is mounted slidably vertically by respective straight sliding guides on a frame, and wherein the translator is configured and arranged to be connected to the support member in order to translate the support member vertically with respect to the respective straight sliding guides and thus vary a distance of the conveyor belt from the position of the support table when the support table is in the second raised position (S2) for the completion of the formation of the stack of interfolded sheets at the desired height; and vertical guide bars of the stack of interfolded sheets, arranged vertically facing one another and parallel in order to laterally guide the stack of interfolded sheets under formation, during the movement of the support table from the first raised position (S1) to the second raised position (S2), and in order to laterally guide the formed stack of interfolded sheets during the movement of the support table from the second raised position (S2) towards the conveyor belt.

* * * * *